United States Patent [19]

Kramer

[11] Patent Number: 5,076,294

[45] Date of Patent: Dec. 31, 1991

[54] FILTER CIGARETTE

[75] Inventor: Anatoly I. Kramer, Winston-Salem, N.C.

[73] Assignee: R. J. Reynolds Tobacco Company, Winston-Salem, N.C.

[21] Appl. No.: 501,207

[22] Filed: Mar. 29, 1990

[51] Int. Cl.[5] ..... A24D 3/00; A24D 3/08

[52] U.S. Cl. ..... 131/331; 131/334; 131/335; 131/342

[58] Field of Search ..... 131/342, 335, 331, 334

[56] References Cited

U.S. PATENT DOCUMENTS

| | | | |
|---|---|---|---|
| 2,682,270 | 6/1954 | Schur . | |
| 2,815,760 | 12/1957 | Schreus et al. . | |
| 2,968,306 | 1/1961 | Touey et al. | 131/334 |
| 3,339,557 | 9/1967 | Karalus . | |
| 3,339,558 | 9/1967 | Waterbury . | |
| 3,368,566 | 2/1968 | Avedikian | 131/331 |
| 3,550,508 | 12/1970 | Wartman, Jr. et al. . | |
| 3,635,226 | 1/1972 | Horsewell et al. . | |
| 3,810,477 | 5/1974 | Berger et al. . | |
| 4,318,417 | 3/1982 | Hiroshi et al. . | |
| 4,466,451 | 8/1984 | Bonnet et al. . | |
| 4,677,995 | 7/1987 | Kallianos et al. . | |
| 4,753,250 | 6/1988 | Bitter et al. | 131/335 |
| 4,836,224 | 6/1989 | Lawson et al. . | |
| 4,964,426 | 10/1990 | Lee et al. . | |

FOREIGN PATENT DOCUMENTS

| | | |
|---|---|---|
| 346648 | 12/1989 | European Pat. Off. . |
| 363288 | 4/1990 | European Pat. Off. . |
| 383018 | 8/1990 | European Pat. Off. . |

*Primary Examiner*—V. Millin

[57] ABSTRACT

A cigarette includes a longitudinally segmented filter element. The filter element includes a segment including at least one organic acid such that greater than 30 weight percent of that segment is organic acid. The cigarette, when smoked, yields tobacco smoke which is not overly harsh.

10 Claims, 1 Drawing Sheet

FILTER CIGARETTE

BACKGROUND OF THE INVENTION

The present invention relates to cigarettes and other types of smoking articles and, in particular, to cigarettes having filter elements comprising at least one organic acid.

Popular smoking articles, such as cigarettes, have a substantially cylindrical rod shaped structure and include a charge of smokable material, such as shreds or strands of tobacco material (i.e., in cut filler form), surrounded by a paper wrapper, thereby forming a tobacco rod. It has become desirable to manufacture a cigarette having a cylindrical filter element aligned in an end-to-end relationship with the tobacco rod. Typically, a filter element includes cellulose acetate tow circumscribed by plug wrap, and is attached to the tobacco rod using a circumscribing tipping material. Certain cigarettes have organic acid additives incorporated therein in order to alter the flavor characteristics and reduce the harshness of cigarette mainstream smoke. See, for example, U.S. Pat. No. 4,836,224 to Lawson et al.

It would be desirable to provide a filter element capable of reducing the harshness of cigarette mainstream smoke.

SUMMARY OF THE INVENTION

The present invention relates to cigarettes including a filter element, and in particular to a cigarette having a longitudinally segmented filter element. In particular, the present invention relates to a cigarette having a filter element which includes a filter segment having a fairly high level of at least one organic acid (e.g., malic acid and/or citric acid). The organic acid has a normally solid form, and preferably has a crystalline form. Solid form organic acid can itself form a filter segment, or the organic acid can be carried by a filter material or other substrate material.

In use, the tobacco rod of a cigarette of the present invention is lit so as to burn that tobacco rod and generate smoke. The smoke is drawn into the smoker's mouth by drawing on the mouthend of the cigarette. As such, the drawn (i.e., mainstream) smoke passes through the filter segment incorporating the organic acid. Preferably, the organic acid-containing filter segment is positioned immediately adjacent to the tobacco rod such that the mainstream smoke exiting the tobacco rod during smoking is not filtered to any significant degree prior to the time that smoke contacts that organic acid-containing filter segment. Thus, it is preferable that moist, essentially unfiltered mainstream smoke contact the filter segment incorporating the organic acid.

Cigarettes of the present invention yield mainstream smoke which is high in mildness attributes and low in harshness attributes. Cigarettes of the present invention also yield a flavorful and aromatic smoke which provides for smoking satisfaction and enjoyment. Preferred cigarettes of this invention do not exhibit undesirable off-tastes upon smoking.

DETAILED DESCRIPTION OF THE PREFERRED EMBODIMENTS

Figure 1:
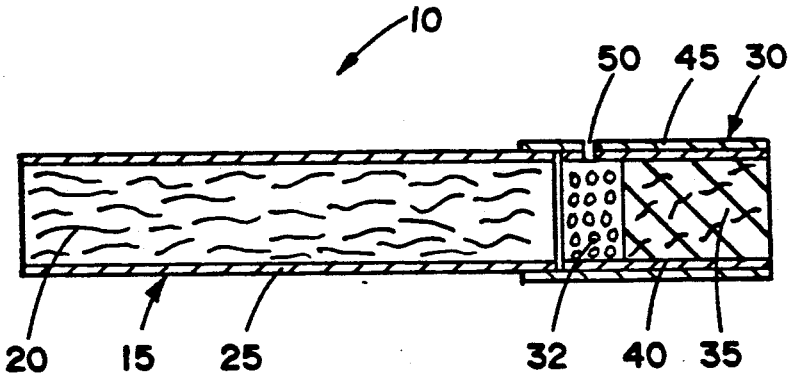
FIGS. 1, 2 and 3 are longitudinal sectional views of cigarettes representative of the present invention.

One embodiment of the present invention is shown in FIG. 1 and has the form of a cigarette 10. The cigarette includes a generally cylindrical rod 15 of smokable material 20, such as tobacco cut filler, contained in circumscribing outer wrapping material 25. The rod 15 is hereinafter referred to as a "tobacco rod." The ends of the tobacco rod are open to expose the smokable material. The cigarette 10 also includes a longitudinally segmented filter element 30 positioned adjacent one end of the tobacco rod 15 such that the filter element and tobacco rod are axially aligned in an end-to-end relationship, preferably abutting one another. Filter element 30 has a generally cylindrical shape, and the diameter thereof is essentially equal to the diameter of the tobacco rod. The ends of the filter element are open to permit the passage of air and smoke therethrough. The filter element 30 includes a first segment 32 of solid organic acid material (e.g., organic acid crystals) and a second segment 35 of filter material. The first and second segments 32, 35 are axially aligned in an end-to-end relationship such that the first segment is adjacent the tobacco rod and the second segment is at the extreme mouthend of the cigarette. The segments are overwrapped with circumscribing plug wrap material 40. The plug wrap material 40 can be common for both filter segments (as shown in FIG. 1), or the filter segments each can be individually wrapped with plug wrap material and plug tube combined.

The filter element 30 is attached to the tobacco rod 15 by tipping material 45 which circumscribes both the entire length of the filter element and an adjacent region of the tobacco rod. The inner surface of the tipping material 45 is fixedly secured to the outer surface of the plug wrap 40 and the outer surface of the wrapping material 25 of the tobacco rod, using a suitable adhesive. If desired, a ventilated or air diluted cigarette is provided with an air dilution means, such as a series of perforations 50 each of which extend through the tipping material and plug wrap.

Figure 2:
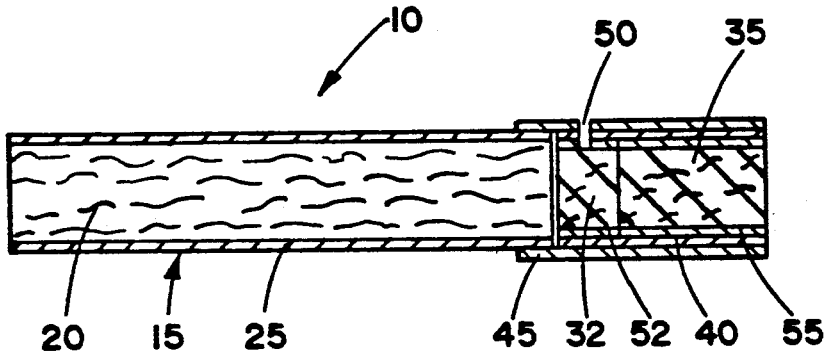

Another embodiment of the present invention is shown in FIG. 2 and has the form of a cigarette 10 which is generally similar to the cigarette described with reference to FIG. 1. However, for the cigarette shown in FIG. 2, the filter element 30 includes a first segment 32 of filter material carrying solid organic acid and a second segment 35 of another filter material. Each segment 32, 35 includes circumscribing plug wrap 52, 55, respectively. The wrapped segments are plug tube combined using circumscribing plug wrap material 40 using known plug tube combining techniques and equipment.

Figure 3:
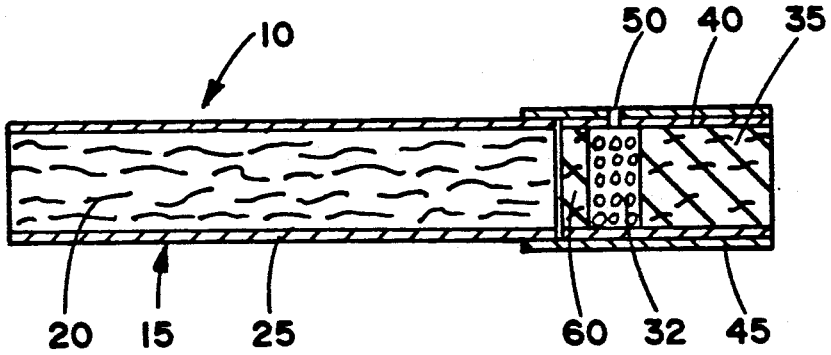

Another embodiment of the present invention is shown in FIG. 3 and has the form of a cigarette 10 which is generally similar to the cigarette described with reference to FIG. 1. However, for the cigarette shown in FIG. 2, the filter element 30 has the form of a so-called "triple-filter." In particular, the triple filter includes a filter segment 60 adjacent the tobacco rod, a filter segment 35 at the extreme mouthend of the cigarette, and a segment 32 including solid organic acid material (e.g., organic acid crystals) positioned between the two other filter segments. Preferably, the filter segment 60 adjacent the tobacco rod is relatively short and exhibits a very low filtration efficiency. The three segments are overwrapped with circumscribing plug wrap material 40.

Typically, the tobacco rod has a length which ranges from about 50 mm to about 85 mm, a circumference of about 17 mm to about 27 mm. The wrapping material which circumscribes the smokable material can vary. Examples of suitable wrapping materials are cigarette paper wrappers available as Ref. Nos. 719, 754, 756, 854 and 856 from Kimberly-Clark Corp. Also suitable are cigarette paper wrappers available as P-2123-101, P-2123-102, P-2123-104, P-2123-106, P-2123-107, P-2123-108, P-2123-109, P-2123-111, P-2123-112, P-2123-114, from Kimberly-Clark Corp.; and cigarette paper Nos. TOD 01788, TOD 03363, TOD 03732, TOD 03957, TOD 03949, TOD 03950, TOD 03953, TOD 03954, TOD 04706, TOD 04742 and TOD 04708 from Ecusta Corp. Certain paper wrappers have low inherent air permeabilities (e.g., permeabilities of less than about 15 CORESTA units). One type of paper wrapper is a low permeability, high basis weight paper having a high surface area calcium carbonate filler and a relatively high application of potassium succinate burn additive. Such a paper is available as P-2123-114 from Kimberly-Clark Corp. Another paper wrapper (i) has a low inherent permeability, high basis weight paper having a calcium carbonate and magnesium hydroxide filler, and a potassium acetate burn chemical, and (ii) has been electrostatically perforated so as to have a relatively high net permeability (e.g., a net permeability of greater than 50 CORESTA units). Such types of papers are provided by electrostatically perforating papers available as Ecusta Experimental Paper Nos. TOD 03732 and TOD 04742 from Ecusta Corp. If desired a dual wrapper system can be employed. The tobacco rods and the resulting cigarettes can be manufactured in any known configuration using known cigarette making techniques and equipment.

Typically, the filter element has a length which ranges from about 15 mm to about 50 mm, preferably about 20 mm to about 35 mm; and a circumference of about 17 mm to about 27 mm. The filter materials of the filter segments can be any suitable filter materials such as cellulose acetate, polypropylene, or the like. The filter materials can be plasticized tow or gathered nonwoven web. The plug wrap typically is a conventional paper plug wrap, and can be either air permeable or essentially air impermeable. However, if desired, a nonwrapped cellulose acetate filter element can be employed. The various filter segments and filter elements suitable for use in this invention can be manufactured using known cigarette filter making techniques and equipment.

Organic acids employed for manufacturing acid-containing filter segments for cigarettes of the present invention can vary. Examples of suitable acids include malic acid, citric acid, levulinic acid, ascorbic acid, tartaric acid, oxalic acid, succinic acid, and the like. The various acids can be employed individually or as blends thereof. Such acids having a normally solid form under ambient conditions of temperature and pressure. The acids preferably are employed in crystalline forms, and have individual particle sizes of about 2 micrometers to about 2 mm, more typically about 5 micrometers to about 1 mm, in diameter. Acids can be employed in a liquid form by coating or sorbing the particular acid onto a solid support or substrate which is incorporated into the filter element. Examples of suitable substrates include carbon particles, activated carbon particles, alumina beads, hollow ceramic spheres, quartz beads, and the like.

The amount of organic acid within the acid-containing filter segment of each cigarette can vary. Typically, the amount of organic acid within each acid-containing filter segment ranges from about 20 mg to about 1 g, and frequently from about 100 mg to about 800 mg. The amount of organic acid within the acid-containing filter segment depends upon factors such as the surface area of the organic acid; the nature of the carrier or substrate onto which the acid is coated or sorbed; the particle size of the acid, carrier or substrate; the chemical nature of the acid or acid mixture; or the particular materials used in manufacturing the filter element. Normally, the length of the acid-containing filter segment is at least about 15 mm, often at least about 10 mm, and frequently at least about 5 mm.

The organic acid-containing filter segment is such that a significant portion of the weight of that segment is provided by the organic acid. In particular, greater than about 30 percent, often greater than about 40 percent, frequently greater than about 50 percent by weight of that acid-containing filter segment is organic acid. Oftentimes, greater than about 70 percent and frequently greater than about 90 percent by weight of the acid-containing filter segment is organic acid.

Typically, the tipping material circumscribes the filter element and an adjacent region of the tobacco rod such that the tipping material extends about 3 mm to about 6 mm along the length of the tobacco rod. Typically, the tipping material is a conventional paper tipping material. The tipping material can have a porosity which can vary. For example, the tipping material can be essentially air impermeable, air permeable, or be treated (e.g., by mechanical or laser perforation techniques) so as to have a region of perforations, openings or vents thereby providing a means for providing air dilution to the cigarette. The total surface area of the perforations and the positioning of the perforations along the periphery of the cigarette can be varied in order to control the performance characteristics of the cigarette.

As used herein, the term "air dilution" is the ratio (generally expressed as a percentage) of the volume of environmental air drawn through the air dilution means to the total volume of air and smoke drawn through the cigarette and exiting the extreme mouthend portion of the cigarette. For air diluted or ventilated cigarettes of this invention, the amount of air dilution can vary. Preferably, the amount of air dilution for a cigarette is greater than about 20 percent, more preferably greater than about 30 percent. The upper limit of air dilution for a cigarette typically is less than about 80 percent, more frequently less than about 60 percent.

Cigarettes of the present invention exhibit a desirable resistance to draw. For example, cigarettes of the present invention exhibit a pressure drop of between about 50 and about 200 mm water pressure drop at 17.5 cc/sec. air flow. Typically, pressure drop values of cigarettes are measured using a Filtrona Filter Test Station (CTS Series) available from Filtrona Instruments and Automation Ltd. Cigarettes of the present invention preferably exhibit resistance to draw values of about 70 to about 180, more preferably about 80 to about 150 mm water pressure drop at 17.5 cc/sec. air flow.

The smokable material employed in the manufacture of the tobacco rod can vary. For example, tobacco material can be engineered in a processed form such as an extruded form (e.g., as a foamed extruded rod or extruded into a tubular shape), have the form of filler such as tobacco cut filler, or the like. Generally, tobacco material of cigarettes has the form of cut filler. As used herein, the terms "filler" or "cut filler" are meant to include tobacco materials which have a form suitable for use in the manufacture of cigarette tobacco rods. As such, filler can include tobacco materials which are blended and are in a form ready for cigarette manufacture. The tobacco filler materials conveniently are employed in the form of strands or shreds as is common in conventional cigarette manufacture. For example, the tobacco cut filler material can be employed in the form of strands cut into widths ranging from about 1/20 inch to about 1/60 inch, preferably from about 1/25 inch to about 1/35 inch. Generally, such strands have lengths which range from about 0.25 inch to about 3 inches. Examples of suitable tobacco materials include flue-cured, Burley, Maryland or Oriental tobaccos; processed tobacco materials such as expanded tobaccos, processed tobacco stems or reconstituted tobacco materials; or blends thereof.

Tobacco materials can be cased and top dressed as is conventionally performed during various stages of cigarette manufacture. For example, additives such as flavorants and humectants can be applied to the tobacco material as is commonly done when cigarettes are manufactured. Suitable additives include flavorants such as vanillin, cocoa, licorice, menthol, tobacco aroma oils, tobacco extracts, and the like. Such additives conveniently are applied to the smokable material as top dressing components, or otherwise blended with the smokable material.

Tobacco material(s) having varying nicotine contents conveniently constitute the smokable filler material useful in manufacturing cigarettes of the present invention. Typically, smokable materials of cigarette of the present invention have nicotine contents of about 0.05 to about 10 percent, often about 1 to about 5 percent, and frequently about 1.5 to about 4 percent, based on the weight of the smokable material within the cigarette.

Cigarettes of the present invention, when smoked under FTC smoking conditions, provide reduced yields of mainstream aldehydes (e.g., formaldehyde) as compared to comparable cigarettes not having the organic acid-containing segment. FTC smoking conditions consist of a 35 ml puff volume of 2 second duration separated by 58 seconds of smolder. Preferred cigarettes of the present invention incorporate an organic acid-containing segment sufficient to reduce the mainstream yield of formaldehyde by greater than 25 percent, more preferably by greater than about 40 percent, and most preferably by greater than about 50 percent, relative to a cigarette of similar format and configuration but not including the organic acid-containing filter segment (i.e., relative to that cigarette not having the organic acid-containing filter segment).

The following examples are provided in order to further illustrate the invention but should not be construed as limiting the scope thereof. Unless otherwise noted, all parts and percentages are by weight.

EXAMPLE 1

Cigarettes having lengths of about 84 mm and circumferences of about 24.85 mm have tobacco rod lengths of 63 mm and filter element lengths of 21 mm. The tobacco rod includes a charge of tobacco cut filler weighing about 0.783 g contained in a circumscribing cigarette paper wrap which is sold commercially as 854 Cigarette Paper by Ecusta Corp. The filter element is manufactured using conventional cigarette filter making technology from cellulose acetate tow (3.3 denier per filament, 44,000 total denier) and circumscribing air permeable paper plug wrap. The tobacco rod and filter element are aligned in an abutting, end-to-end relationship and secured together using an air permeable tipping paper. The tipping paper is adhesively secured to the filter element and the adjacent portion of the tobacco rod. The tipping material circumscribes the length of the filter element and about 3 mm of the length of the tobacco rod. A 2 mm wide band of perforations is provided around the periphery of the cigarette about 13 mm from the extreme mouthend thereof. The cigarette is 10 percent air diluted.

The filler material employed in providing the tobacco rod is in the form of strands cut at about 32 blend of about 15 percent Burley tobacco, about 22 percent flue-cured tobacco, about 23 percent reconstituted tobacco material, about 16 percent Turkish tobacco, and about 18 percent volume expanded Burley and flue-cured tobaccos. The nicotine content of the blend is about 1.9 percent. The blend has about 3 percent casing and top dressing applied thereto. The moisture content of the blend is about 12 percent.

The cellulose acetate filter element is carefully removed from the cigarette, and about 0.13 g of tobacco filler adjacent the filter element is carefully removed from the cigarette through the extreme mouthend of the cigarette. Into the mouthend of the cigarette is inserted about 0.7 g of 99 percent pure malic acid crystals (available from Aldrich Chemical Co., Inc.) having an average particle size of about 5 micrometers to about 50 micrometers in diameter. The organic acid crystals are thereby positioned adjacent one end of the tobacco rod, and extend about 10 mm along the length of the cigarette, thereby forming a filter segment. Then, a 21 mm length of the cellulose acetate filter segment is inserted into the filter region.

The cigarette is smoked to a butt length of 40 mm under FTC smoking conditions of 35 ml puff volume of 2 second puff duration, separated by 58 seconds of smolder. The cigarette yields 8.8 mg "tar," 0.65 mg nicotine and 10.2 micrograms formaldehyde. For comparison purposes, a cigarette having the 63 mm tobacco rod and 21 mm cellulose acetate filter element is smoked to a 40 mm butt length under FTC smoking conditions. The comparison cigarette yields 9.5 mg "tar," 0.70 mg nicotine and 22 micrograms formaldehyde. The cigarette of the present invention, which includes the malic acid-containing filter segment, provides a significant reduction in formaldehyde yield as compared to a control cigarette not including an acid-containing filter segment.

EXAMPLE 2

Cigarettes are provided essentially as described in Example 1. However, the smokable material is flue-cured tobacco cut filler. The nicotine content of the tobacco cut filler is about 0.59 percent.

The cigarette is smoked to a butt length of 40 mm under FTC smoking conditions. The cigarette yields 12.7 mg "tar," 0.18 mg nicotine and 34 micrograms formaldehyde. A comparison cigarette, not having a malic acid-containing filter segment, is similarly smoked and yields 14.3 mg "tar," 0.20 mg nicotine and 73 micrograms formaldehyde.

EXAMPLE 3

Cigarettes are provided essentially as described in Example 2. However, the malic acid is replaced with 0.7 g of citric acid monohydrate crystals (available from Aldrich Chemical Co., Inc.) of 99 percent purity and having an average particle size of about 0.2 mm to about 0.6 mm.

The cigarette is smoked to a butt length of 40 mm under FTC smoking conditions. The cigarette yields 14.7 mg "tar," 0.20 mg nicotine and 45 micrograms formaldehyde.

EXAMPLE 4

Cigarettes are provided essentially as described in Example 1. However, the smokable material is flue-cured tobacco cut filler. The nicotine content of the tobacco blend is about 4.65 percent.

The cigarette is smoked to a butt length of 40 mm under FTC smoking conditions. The cigarette yields 18.8 mg "tar," 2.86 mg nicotine and 44 micrograms formaldehyde. A comparison cigarette, not having a malic acid-containing filter segment, is similarly smoked and yields 19.3 mg "tar," 3.06 mg nicotine and 61 micrograms formaldehyde.

EXAMPLE 5

Cigarettes are provided essentially as described in Example 4. However, the malic acid is replaced with 0.7 g of citric acid monohydrate crystals of the type described in Example 3. The nicotine content of the tobacco blend is about 4.65 percent.

The cigarette is smoked to a butt length of 40 mm under FTC smoking conditions. The cigarette yields 18.8 mg "tar," 2.79 mg nicotine and 38 micrograms formaldehyde.

EXAMPLE 6

A cigarette rod of 84 mm length and 24.54 mm circumference is provided using the blend of tobaccos described in Example 1 and a citric acid-containing filter element. The length of the tobacco rod is about 57 mm and the length of the filter element is about 27 mm. The filter element includes a gathered web of nonwoven polypropylene sheet available as PP-100 from Kimberly-Clark Corp. and a circumscribing nonporous paper plug wrap available as Ref. No. 646 from Ecusta Corp. The filter rod weighs about 0.973 g per 100 mm length. The rod is manufactured using the apparatus and method generally described in Example 1 of U.S. Pat. No. 4,807,809 to Pryor et al.

The filter rod is inserted into a tube having an inner diameter essentially equal to the outer diameter of the rod. Into the tube is poured 20 g of a solution of 10 g citric acid and 10 g water, so as to contact the polypropylene filter material and pass through the filter rod. The rod then is dried to constant weight at 70° F. and 50 percent relative humidity. The resulting filter rod weighs about 1.627 g per 100 mm length. Thus, the filter element includes about 40.2 material.

The cigarette is smoked under FTC smoking conditions to a butt length of about 28 mm. The cigarette yields 20.0 mm "tar" and 1.27 mg nicotine. A comparison cigarette, having a polypropylene filter element which is not treated with organic acid, is similarly smoked and yields 22.2 mg "tar" and 1.37 mg nicotine. The cigarette having the citric acid-containing filter segment yields mainstream smoke which is less harsh than the comparison cigarette.

What is claimed is:

1. A cigarette having a rod of smokable material contained in a circumscribing outer wrapping material and a longitudinally segmented filter element; the filter element comprising (A) a filter segment (i) including at least one organic acid such that greater than about 30 weight percent of that segment is organic acid, and (ii) positioned immediately adjacent to the rod of smokable material such that mainstream smoke exiting the rod during smoking is not filtered prior to contact therewith, and (B) a second filter segment at the extreme mouthend of the cigarette.

2. The cigarette of claim 1 wherein the filter element comprises a segment including at least one organic acid such that greater than about 40 weight percent of that segment is organic acid.

3. The cigarette of claim 1 wherein the filter element comprises a segment including at least one organic acid such that greater than about 50 weight percent of that segment is organic acid.

4. The cigarette of claim 3 wherein the organic acid is in crystalline form.

5. The cigarette of claim 1, 2, 3 or 4 which yields a reduction in mainstream formaldehyde of greater than about 25 percent when smoked under FTC conditions of 35 ml puff volume of a 2 second duration taken every 58 seconds, relative to that cigarette not having a filter segment including at least one organic acid.

6. The cigarette of claim 1, 2, 3 or 4 which yields a reduction in mainstream formaldehyde of greater than about 40 percent when smoked under FTC conditions of 35 ml puff volume of a 2 second duration taken every 58 seconds, relative to that cigarette not having a filter segment including at least one organic acid.

7. The cigarette of claim 1, 2, 3 or 4 which yields a reduction in mainstream formaldehyde of greater than about 50 percent when smoked under FTC conditions of 35 ml puff volume of a 2 second duration taken every 58 seconds, relative to that cigarette not having a filter segment including at least one organic acid.

8. The cigarette of claim 1 or 3 wherein the amount of organic acid within each filter segment including organic acid ranges from about 100 mg to about 800 mg.

9. A cigarette having a rod of smokable material contained in a circumscribing outer wrapping material and a longitudinally segmented filter element; the filter element comprising a filter segment including malic acid such that greater than about 30 weight percent of that segment is malic acid.

10. A cigarette having a rod of smokable material contained in a circumscribing outer wrapping material and a longitudinally segmented filter element; the filter element comprising a filter segment including citric acid such that greater than about 30 weight percent of that segment is citric acid.

* * * * *

UNITED STATES PATENT AND TRADEMARK OFFICE

CERTIFICATE OF CORRECTION

PATENT NO. : 5,076,294

DATED : December 31, 1991

INVENTOR(S) : Anatoly I. Kramer

It is certified that error appears in the above—identified patent and that said Letters Patent is hereby corrected as shown below:

On the Title Page following cited FOREIGN PATENT DOCUMENTS:

Insert --"OTHER PUBLICATIONS", Eastman Chemical Company, Publication No. FTR-80--.

Col. 6, line 20, after "32" insert --cuts per inch. The initial filler material includes a--.

Signed and Sealed this

Seventh Day of September, 1993

Bruce Lehman

*Attest:*

BRUCE LEHMAN

*Attesting Officer*

*Commissioner of Patents and Trademarks*